US005359770A

United States Patent [19]

Brown et al.

[11] Patent Number: 5,359,770

[45] Date of Patent: Nov. 1, 1994

[54] METHOD FOR BONDING ABRASIVE BLADE TIPS TO THE TIP OF A GAS TURBINE BLADE

[75] Inventors: Lawrence E. Brown, Indianapolis; David L. Clingman, Carmel; Michael J. Barber; John F. Kroemer, both of Martinsville; Kenneth R. Cross, Lebanon, all of Ind.

[73] Assignee: General Motors Corporation, Detroit, Mich.

[21] Appl. No.: 941,617

[22] Filed: Sep. 8, 1992

[51] Int. Cl.[5] ..... B23P 15/00

[52] U.S. Cl. ..... 29/889.1; 29/889.71; 416/224

[58] Field of Search ..... 29/889.1, 889.7, 889.71; 416/224

[56] References Cited

U.S. PATENT DOCUMENTS

| | | | |
|---|---|---|---|
| 3,053,694 | 9/1962 | Daunt et al. | 29/889.1 |
| 4,214,355 | 7/1980 | Zelahy | 29/889.1 |
| 4,249,913 | 2/1981 | Johnson et al. | 51/295 |
| 4,610,698 | 9/1986 | Eaton et al. | 51/295 |
| 4,741,973 | 5/1988 | Condit et al. | 428/553 |
| 4,808,055 | 2/1989 | Wertz et al. | 29/889.1 |
| 4,851,188 | 7/1989 | Schaefer et al. | 29/889.71 |
| 4,854,196 | 8/1989 | Mehan | 76/101 R |
| 5,048,183 | 9/1991 | Cang et al. | 29/889.1 |
| 5,113,582 | 5/1992 | Monson et al. | 29/889.1 |
| 5,174,024 | 12/1992 | Sterrett | 29/889.1 |
| 5,264,011 | 11/1993 | Z . | |

FOREIGN PATENT DOCUMENTS 2108534 10/1982 United Kingdom .

*Primary Examiner*—Irene Cuda

*Attorney, Agent, or Firm*—Cary W. Brooks

[57] ABSTRACT

An abrasive system and a processing procedure is provided which permits the direct installation of a thick abrasive blade tip cap onto a cast turbine rotor blade during a heating schedule which requires two furnace operations. The composition of the abrasive blade tip cap advantageously utilizes the high temperature performance capabilities of equiaxed or single crystal rotor blade alloys without significantly affecting their mechanical properties as a consequence of the processing necessary to permanently bond the abrasive blade tip cap to the rotor blade. A semi-rigid mat consisting of the preferred abrasive composition is first consolidated in a first vacuum furnace operation. Blade tip cap preforms are then cut from the mat and positioned on the tip of the rotor blade. The preform and rotor blade are then heated in a vacuum furnace according to a temperature schedule entailing heating rates, holding temperatures and durations which are sufficient to bond the preform to the rotor blade. The rotor blade is then rapidly cooled in the vacuum furnace to retain the microstructure and mechanical properties of the rotor blade.

20 Claims, 1 Drawing Sheet

METHOD FOR BONDING ABRASIVE BLADE TIPS TO THE TIP OF A GAS TURBINE BLADE

The present invention generally relates to abrasive materials and methods for adhering abrasive materials to a substrate. More particularly, this invention relates to an improved abrasive material and method for bonding the abrasive material to a gas turbine rotor blade wherein the physical properties of either an equiaxed or single crystal turbine rotor blade are substantially preserved and unaffected by the bonding process.

BACKGROUND OF THE INVENTION

In the turbine section of a turbine engine, the turbine rotor is circumscribed by a shroud such that the shroud is adjacent to the tips of the rotor blades extending from the hub of the rotor. The shroud serves to channel the combustion gases through the turbine section of the turbine engine and prevents the bulk of the turbine engine's combustion gases from bypassing the turbine rotor blades. However, a portion of the gases are able to bypass the rotor blades through a gap present between the rotor blade tips and the shroud. Because the energy of the gases directed through the rotor blades is used to rotate the turbine rotor assembly and any compressor upstream of the turbine section, turbine engine efficiency can be increased by limiting the gases which are able to bypass the rotor blades through this gap.

Manufacturing tolerances, differing rates of thermal expansion and dynamic effects limit the extent to which this gap can be reduced. Any rubbing contact between the rotor blade tips and the shroud will spall the tips of the rotors. Spalling will tend to further increase the gap described above, thereby reducing engine efficiency. In addition, spalling tends to promote structural fatigue in the rotor blades, causing the useful life of the rotor to be shortened.

As an alternative, it is well known in the art to form a dynamic seal between the rotor blades and the shroud by forming an abrasive tip cap on the end of one or more rotor blades, and more preferably, on each rotor blade. During operation of the turbine, the abrasive tip caps abrade a groove in the shroud as a result of numerous "rub encounters" between the abrasive tip caps and the shroud. The groove, in cooperation with the rotor blade tips as they partially extend into the groove, forms a virtual seal between the rotor blade tips and the shroud. The seal reduces the amount of gases which can bypass the rotor blades, and thereby improves the efficiency of the turbine engine.

Various materials and processes have been suggested to provide a suitable abrasive tip cap on turbine rotor blades. Typical abrasive materials used include silicon carbide, aluminum oxide, tantalum carbide and cubic boron nitride. Aluminum oxide, or alumina, is generally preferred because of its high temperature capabilities and oxidation resistance. In that such abrasive particles do not provide a structurally sound material, they are incorporated with a metal matrix, including for example, nickel or cobalt-base alloys, to provide a sufficiently strong structure which can be bonded to the blade tip. However, the thickness of such a metal matrix is often limited because of the structural weakness of the abrasive composition.

In some applications, it is conventional to apply the abrasive composition to the rotor blade tip using a thermal spray technique, such as plasma spraying or detonation gun spraying. While suitable for many purposes, thermal spray techniques are inefficient in that only part of the abrasive composition contacts and adheres to the rotor blade tip, while much of the thermal spray completely misses the target. More importantly, thermal spraying damages or destroys the morphology of the abrasive particles, making them unsuitable for the intended purpose. In addition, subsequent processes are typically necessary to provide the adhesion and structural integrity necessary for the abrasive composition to survive the hostile environment of a turbine engine. Such steps often include adhering the abrasive composition to the blade tip during a first heating and cooling cycle, and later depositing an additional quantity of the metal matrix over the abrasive composition through a second heating and cooling cycle, such as during hot isostatic pressing. As an alternative, it has also been suggested to melt the tip of the blade, such as with lasers, introduce the abrasive to the blade tip, and then resolidify the blade tip.

While the above processes may be suitable for some turbine blade structures, turbine blades used in modern gas turbine engines are often fabricated from cast high temperature nickel-base superalloys having a single crystal microstructure. Single crystal blades are characterized by extremely high oxidation resistance and mechanical strength at elevated temperatures, which are necessary for the performance requirements of modern turbine engines. However, the single crystal microstructure must not be affected by the process by which the rotor blade abrasive tip caps are secured to the rotor blades. In particular, the process must not recrystallize the microstructure such that the high temperature properties of the rotor blade are lost or diminished. As a result, processes which entail melting the rotor blade tip are entirely unacceptable, and repeated thermal cycling of the rotor blades runs the risk of degrading the single crystal microstructure.

U.S. patent application Ser. No. 07/941,618, now U.S. Pat. No. 5,264,011, to Brown et al. and assigned to the assignee of this patent application, teaches a method by which a rotor blade abrasive tip cap can be bonded to a single crystal rotor blade in which degradation of the microstructure of a single crystal turbine rotor blade is minimized. The method entails the use of an abrasive preform whose composition includes a metal powder matrix containing a cobalt-base braze alloy and a cobalt alloy containing boron.

The abrasive preform is semi-rigid and thick, permitting it to be physically placed directly on the rotor blade tip. Therefore, the need for thermal spray operations to deposit the abrasive composition onto the rotor blade tip is eliminated. Another advantage of the thick configuration of the preform is that the resulting abrasive blade tip cap has sufficient thickness so as to provide stock for machining to tolerance while also retaining adequate thickness to perform repeated rub encounters with a turbine engine shroud over the life of the turbine engine.

The abrasive composition is formulated to take advantage of the high temperature capabilities of a single crystal rotor blade such that a single heating cycle can be used to both consolidate the abrasive composition and bond the abrasive preform to the tip of the rotor blade. As a result, the abrasive composition and method taught provide an efficient and economical process for forming abrasive tip caps on single crystal rotor blades.

Though the above process and abrasive composition have proven to be quite satisfactory for many applications, it has been discovered that some degradation of long-term mechanical properties occurs in the single crystal turbine rotor blades. Moreover, multiple processing cycles further degrade the mechanical properties of the blades, practically eliminating the ability to both rework and retip the single crystal rotor blades processed in this manner. Further, the above process may degrade the microstructure and properties of an equiaxed grain turbine blade so severely as to render the blade unusable.

Thus, it would be desirable to provide an abrasive composition which can be readily formed into a rigid abrasive blade tip cap preform, to permit the preform to be physically placed on a rotor blade tip prior to bonding, and provide a bonding cycle which prevents degradation of the microstructure of a cast turbine rotor blade, whether it is equiaxed grain or single crystal.

SUMMARY OF THE INVENTION

It is an object of this invention to provide a method for attaching an abrasive blade tip cap to a rotor blade in a manner that preserves the microstructure of both equiaxed and single crystal rotor blades.

It is a further object of this invention that such a method include the formulation of an abrasive blade tip cap preform which can be consolidated during a first furnace cycle, and then adhered to a rotor blade during a second heating and cooling cycle.

It is another object of this invention that such an abrasive blade tip cap preform be of sufficient thickness so as to provide sufficient stock for machining the abrasive blade tip cap to tolerance while retaining adequate thickness to perform repeated rub encounters with a turbine engine shroud over the life of the turbine engine.

Lastly, it is an object of this invention that such a method for formulating and bonding an abrasive blade tip cap allow for repeated rework and/or refurbishment cycles, with little or no degradation of the microstructure or properties of both equiaxed and single crystal turbine blades.

In accordance with a preferred embodiment of this invention, these and other objects and advantages are accomplished as follows.

According to the present invention, there is provided an abrasive composition and a process for attaching the abrasive composition to a rotor blade of a turbine engine, wherein the process entails consolidating the abrasive composition during a first heating cycle, and then adhering the abrasive composition to the tip of the rotor blade during a second heating cycle. The first heating cycle effectively consolidates the abrasive composition, while the second heating cycle bonds the abrasive composition to the rotor blade without degrading its microstructure. The abrasive composition and processes of the present invention are applicable to both equiaxed and single crystal rotor blades.

The abrasive composition is preferably formed as a mat from which numerous abrasive blade tip cap preforms can be cut. The abrasive composition includes a metal powder matrix containing a cobalt-base braze alloy and a cobalt alloy containing boron in sufficient amounts to aid in wetting and bonding together all of the preform constituents into a fully densified matrix. More particularly, for the abrasive composition to both consolidate and bond properly, it has been found that the boron content must be limited to, on the basis of weight percent of the preform, greater than about one percent but less than about two percent so as to minimize degradation of the mechanical properties of the turbine blade material.

Ceramic abrasive particles, and preferably aluminum oxide particles, are interspersed in the metal powder matrix. The ceramic abrasive particles are coated with a thin layer of a reactive metal, such as titanium, which serves as a wetting agent to promote a metallurgical bond between the abrasive particles and the metal powder matrix. In addition, it is preferable that a binder be distributed throughout the abrasive composition to impart green strength to the mat prior to consolidation.

The consolidation and bonding processes of this invention consist of a first heating and cooling cycle which serves to consolidate the mat. Because the consolidation process is performed without the rotor blade, higher temperatures are permitted which can suitably melt the cobalt alloy and boron constituents of the mat. After consolidation, rotor blade tip cap preforms are cut to fit the shape of the rotor blade tip. Because the consolidated mat is rigid, the preform must be weighted or clamped sufficiently such that the entire bonding surface of the preform will creep and make contact with the bonding surface of the rotor blade tip during the bonding cycle.

Together, the preform and rotor blade then undergo a second furnace operation which bonds the preform to the rotor blade tip. This furnace operation can be specifically limited to the temperature capability of the rotor blade, whether it has an equiaxed or a single crystal microstructure, such that degradation of the rotor blade's microstructure and mechanical properties are prevented. With the preferred heating schedules of the present invention, the abrasive particles are tightly bonded within the metal powder matrix, and the rotor blade tip cap is tightly bonded to the rotor blade such that the rotor blade tip cap forms a structurally integral portion of the rotor blade in terms of strength and durability.

The process permits relatively thick preforms to be bonded to the rotor blades such that subsequent machining of the rotor blade tips in the assembled rotor can be performed to bring the rotor assembly into tolerance, while also ensuring that sufficient abrasive material will remain to provide repeated rub encounters over the life of the turbine engine. As a result, the abrasive rotor blade tip cap possesses the capability for long service life, and provides the requisite rubbing action with the shroud during the operation of a turbine engine so as to form a seal between the rotor blades and the shroud.

Other objects and advantages of this invention will be better appreciated from the following detailed description.

BRIEF DESCRIPTION OF THE DRAWINGS

The above and other advantages of this invention will become more apparent from the following description taken in conjunction with the accompanying drawing wherein.

DETAILED DESCRIPTION OF THE INVENTION

An abrasive system and a processing procedure is provided which permits the consolidation of a thick abrasive blade tip cap during a first furnace operation, after which the abrasive blade tip cap is bonded to a cast turbine rotor blade during a second furnace operation. In particular, the second furnace operation is conducted at a lower temperature than the first furnace operation so as to avoid any degradation of the microstructure and properties of the rotor blade material. The composition of the abrasive blade tip cap advantageously allows the creation of a suitable bond without significantly affecting the mechanical properties of equiaxed or single crystal rotor blades.

While it is a significant advantage of the present invention that the abrasive system and processes are equally applicable to equiaxed rotor blades, the composition of the preferred abrasive blade tip cap and the preferred heating schedules are particularly adapted for cast single crystal nickel-base superalloys. The preferred nickel-base superalloy consists nominally of, by weight, about 10 percent tungsten, about 10 percent cobalt, about 9 percent chromium, about 5.5 percent aluminum, about 1.5 percent tantalum, about 1.5 percent titanium, about 1.0 percent hafnium, about 0.02 percent boron, about 2.5 percent molybdenum, about 0.15 percent carbon, and about 0.05 percent zirconium, with the balance being nickel. Such an alloy is commercially available from Cannon-Muskegon under the trade designation CMSX-3. However, it is foreseeable that other suitable nickel-base alloys, as well as cobalt-base or iron-base alloys, could be substituted with similar results.

Figure 1:
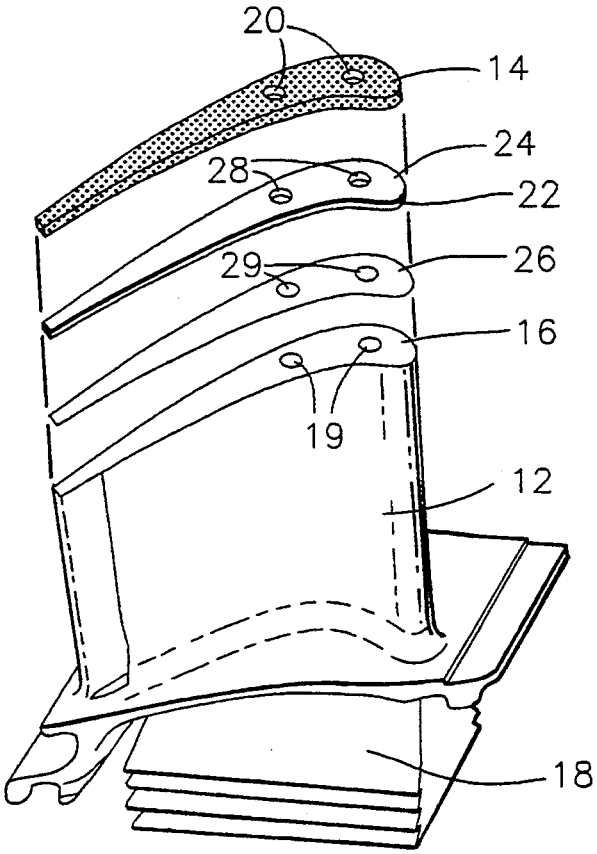
FIG. 1 shows an exploded view of the component details of a turbine rotor blade and abrasive rotor blade tip cap in accordance with this invention.
Figure 2:
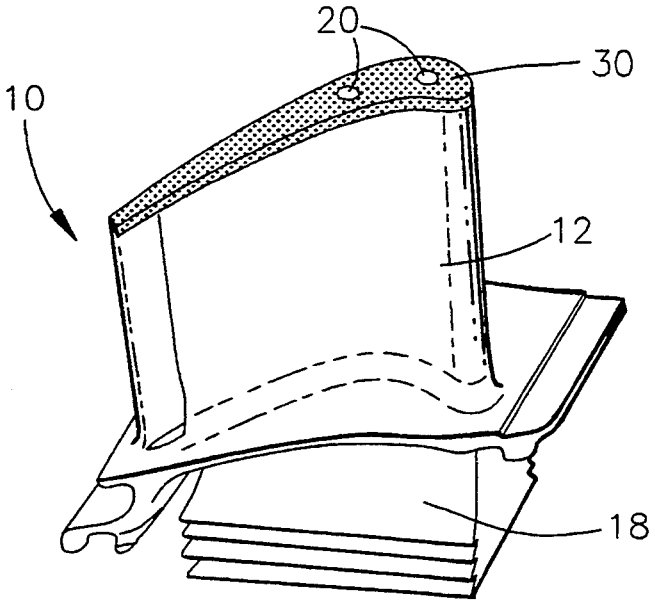
FIG. 2 shows a side view of a turbine rotor blade on which there has been attached an abrasive rotor blade tip cap in accordance with this invention.

In accordance with the preferred embodiment of this invention, an abrasive blade tip cap preform 14 is brazed to a turbine rotor blade 12 (FIG. 1) to form an abrasive blade tip cap 30 of an abrasive rotor blade 10 (FIG. 2). As seen in FIG. 1, the rotor blade 12 has a tip portion 16 which is remote from the rotor blade's base 18 by which the rotor blade 12 is mounted to a rotor hub (not shown) to form a turbine rotor assembly (not shown). The tip 16 of the rotor blade 12 is substantially flat, though having a compound curvature referred to as the arc drop. The arc drop of the blade tip 16 results from the rotor blade 12 being ground to conform to the cylindrical internal surface of the turbine shroud (not shown).

The abrasive blade tip cap preform 14 can be attached to one or more rotor blades 12 according to the method of the present invention, though in the preferred embodiment, each rotor blade 12 would have an abrasive blade tip cap preform 14 bonded thereto. With the abrasive rotor blades 10 mounted to the hub within a turbine engine (not shown), the abrasive blade tip caps 30 will be proximate to the shroud which circumscribes the turbine rotor assembly. The abrasive blade tip caps 30 serve to wear-form a seal track in the shroud, resulting in a virtual seal between the abrasive rotor blades 10 and the shroud which substantially prevents combustion gasses from bypassing the rotor assembly. A particular aspect of the preferred composition of the abrasive blade tip caps 30 is the ability to withstand repeated and severe rub encounters with the shroud, with only minimal loss of material from the abrasive blade tip caps 30 and preferential wear of the shroud material.

The preferred abrasive composition from which the abrasive blade tip cap preform 14 is formed is initially provided in the form of a semi-rigid mat of uniform thickness. The mat preferably consists of multiple thin layers, each layer containing a blend of the preferred abrasive composition. For practical reasons, the mat is sufficiently sized such that several preforms 14 can be obtained from a single mat after consolidation, during which the abrasive composition forms a fully densified matrix.

The abrasive composition of the present invention includes a metal powder matrix combined with ceramic abrasive particles. The abrasive particles are preferably about 80 to 120 mesh grit aluminum oxide particles which are coated with a reactive metal. The coated aluminum oxide particles preferably make up about 24 to about 28 weight percent, and more preferably about 26.3 weight percent, of the abrasive blade tip cap preform 14, though it is foreseeable that the coated aluminum oxide could be present in quantities of as little as 10 or as great as 50 weight percent.

Most preferably, the reactive metal coating on the aluminum oxide particles is a titanium coating which constitutes about 1.8 to about 4 weight percent of the coated aluminum oxide particles. As a reactive metal, the titanium serves to wet the surface of the aluminum oxide particles to promote a metallurgical bond between the particles and the metal powder matrix. Although titanium is preferred because it is known to react to both aluminum oxide and the matrix to form a metallurgical bond, other reactive metals could also be used. It is preferable that the titanium coating be applied using known fluidized bed chemical vapor deposition techniques so as to ensure uniformity of the coating on the particles, though other suitable processes known in the art are acceptable.

The metal powder matrix is a mixture of a cobalt-base braze alloy combined with a cobalt alloy that includes boron. The cobalt-base braze alloy is preferably Aerospace Material Specification 4783 (AMS 4783) having a nominal composition by weight of about 8 percent silicon, about 19 percent chromium, about 17 percent nickel, about 4 percent tungsten, about 0.8 percent boron, with the balance being cobalt. The cobalt-base braze alloy is preferably provided in particle form and has a particle size no greater than about 325 mesh. The cobalt-base braze alloy makes up about 22 to about 26 weight percent, and more preferably about 24.3 weight percent, of the abrasive blade tip cap preform 14, though it is foreseeable that the cobalt-base braze alloy could be present in quantities of as little as about 20 or as great as about 30 weight percent.

The boron-containing cobalt alloy is a proprietary composition manufactured by Union Carbide Specialty Powders of Indianapolis, Ind., and designated as Alloy No. CO-274. Similar to the cobalt-base braze alloy, the boron-containing cobalt alloy is provided in particle form and has a particle size no greater than about 325 mesh. In the preferred embodiment, the boron-containing cobalt alloy makes up about 46 to about 50 weight percent, and more preferably about 49.2 weight percent, of the abrasive blade tip cap preform 14, though it is foreseeable that it could be present in quantities of as little as 42 or as great as 52 weight percent.

The boron furnished by the boron-containing cobalt alloy must be present within the preform 14 in sufficient amounts to depress the melting point of the metal matrix, wet, and bond together all the preform constituents into a fully-densified matrix without diffusing into and lowering the melting point and resultant properties of the rotor blade material. More specifically, it has been found that a boron content in the preform 14 of greater than about 1 weight percent but less than about 2 weight percent is necessary to obtain suitable results according to the method of the present invention.

As a final preferred additive, the preform 14 may include a binder which is distributed throughout the metal powder matrix in sufficient quantities to impart green strength to the preform 14. Such binders are well known in the art. However, the preferred embodiment utilizes a proprietary organic binder, Allison Type GAB/Production, available from Vitta Corporation of Bethel, Conn. The binder preferably makes up between about 2 and about 5 additional weight percent of the abrasive blade tip cap preform 14, though it is foreseeable that the binder can be present in quantities of as little as about 1.0 and as great as about 7.0 weight percent, in that the desired amount is dictated only by the amount of green strength desired in the abrasive blade tip cap preform 14 and the level of porosity resulting from binder volatilization which can be allowed in the consolidated abrasive blade tip cap 30.

Contrary to the teachings of the aforementioned U.S. patent application to Brown et al., the preferred abrasive composition of the present invention does not require or necessarily employ a fluorocarbon powder as a bond enhancer. As will become apparent below, the consolidation process of the present invention is performed at higher temperatures than allowable under the previously taught method, thereby reducing or negating the need for such a constituent. A preferred fluorocarbon powder, if utilized, is Product No. MP 1100, available from E. I. DuPont de Nemours and Company, Inc., Polymer Products Department, of Wilmington, Del.

Though the preform 14 need only consist of a single layer, as shown in FIG. 1, an approximately 0.003 to about 0.004 inch thick layer (not shown) of the AMS 4783 cobalt-base braze alloy may also be applied on top of the first layer. If employed, the second layer serves as a reservoir to replace the organic binder which is volatilized during the consolidation heating cycle, thereby filling any voids which may occur due to the volatilization. As a result, the second layer minimizes porosity in the preform 14 which may otherwise be created. However, the relatively high consolidation temperature of the present invention redistributes, slightly, the metal powder matrix within the preform 14 so as to also fill any voids, thereby making the use of the reservoir layer optional.

With or without the second layer, the mat from which the preform 14 is obtained preferably has a thickness of about 0.055 to about 0.063 inch prior to consolidation. However, the thickness of the mat may vary substantially, depending on the blade design. Generally, mat thickness is dictated by desired cutting life and machining stock required. Due to the thickness of the mat and the green strength contributed by the binder, the mat is sufficiently rigid to permit handling under most manufacturing conditions.

Consolidation processing is carried out in an inert atmosphere, such as preferably a clean, out-gassed vacuum furnace which has a leak rate not exceeding 10 microns per hour. The mat is supported in the vacuum furnace on an underlying substrate which will not pose a contamination hazard, such as an aluminum oxide substrate. A vacuum pressure of about $1\times10^{-4}$ torr or less is preferably maintained throughout the entire consolidation process. The heating rates, durations and limits for the preferred consolidation heating schedule are detailed in Table I below.

TABLE I

PREFERRED CONSOLIDATION FURNACE SCHEDULE

| RATE | TEMPERATURE/TIME |
|---|---|
| Heat 10° F./minute (max) | Room temperature to 500 +/− 25° F. |
| Hold at: | 500 +/− 25° F. for about 5 minutes |
| Heat 3° F./minute (max) | 500 +/− 25° F. to 750 +/− 25° F. |
| Hold at: | 750 +/− 25° F. for about 5 minutes |
| Heat 6° F./minute (max) | 750 +/− 25° F. to 900 +/− 25° F. |
| Hold at: | 900 +/− 25° F. for about 5 minutes |
| Heat 3° F./minute (max) | 900 +/− 25° F. to 1100 +/− 25° F. |
| Hold at: | 1100 +/− 25° F. for about 5 minutes |
| Heat 15° F./minute (min) | 1100 +/− 25° F. to 2000 +/− 25° F. |
| Hold at: | 2000 +/− 25° F. for about 10 minutes |
| Heat 30° F./minute (max) | 2000 +/− 25° F. to 2300 +/− 15° F. |
| Hold at: | 2300 +/− 15° F. for about 110 to about 130 minutes |
| Vacuum or gas cool | 2300 +/− 15° F. to 2000 +/− 25° F. |
| Gas fan cool | 2000 +/− 25° F. to room temperature |

Note: Temperatures given are set points;
+/− tolerances are the preferred control ranges.

The preferred temperatures and durations indicated above are selected to perform the following. First, the abrasive mat is heated to a temperature of about 1100° F.±25° F. at a rate and for a duration which will be sufficient to ensure complete diffusion of the volatilized gasses through the abrasive mat. As shown in Table I, intermediate holding temperatures of 500° F., 750° F. and 900° F. are preferred to prevent porosity formation, but these intermediate holding temperatures are not absolutely necessary. The abrasive mat is preferably held at about 1100° F.±25° F. for about 5 minutes, which is sufficient to prevent porosity within the abrasive mat.

The temperature of the abrasive mat is then further raised at a rate of about 15° F. per minute minimum, and held at about 2000°±25° F. for about 10 minutes, a duration which is sufficient to thermally stabilize the abrasive mat. Thereafter, the temperature of the abrasive mat is further raised at a rate of about 30° F. per minute maximum, which is sufficient to prevent liquation of the matrix material in the abrasive mat, and held at about 2300°±15° F. for about 110 to about 130 minutes, a duration which is sufficient to melt and consolidate the metal powder matrix. The molten metal powder matrix forms a liquid phase which surrounds the abrasive particles. In addition, the molten metal powder matrix wets and reacts with the titanium coating on the abrasive particles in a manner that produces a strong metallurgical bond upon cooling.

In particular, it is believed that the titanium in immediate contact with the aluminum oxide surface bonds to oxygen in the aluminum oxide, essentially becoming a part of the oxide structure. Titanium which is located in the coating further from the aluminum oxide particle remains metallic. Because of its metallic nature, the titanium coming in contact with the molten metal powder matrix improves wetting and probably alloys itself with the braze alloy. Thus, both the abrasive particle-titanium interface and the titanium-matrix interface are strengthened by chemical bonding.

Following consolidation, preforms 14 are cut from the now rigid mat to closely fit the shape of the blade tip 16. No allowance is necessary for shrinkage of the preform 14 during the bonding process that follows after consolidation of the abrasive mat. As a result, it is preferable that the preforms 14 be precisely cut from the mat using such techniques as computer-controlled laser, water-jet, abrasive water-jet, or other alternative precision cutting processes. In addition, if the tip 16 of the rotor blade 12 has dust exit holes 19, as shown in FIG. 1, corresponding dust exit holes 20 must be formed in the preform 14 during this operation.

The environment in which the preform 14 is applied to the rotor blade 12 must be clean to prevent contamination of the bonding surfaces of either the rotor blade 12 or the preform 14. The procedure for applying the preform 14 to the rotor blade 12 includes forming a bonding surface on the rotor blade tip 16 which is ground smooth with no burrs (approximately a surface finish of about 32 Ra or finer). The rotor blade 12 is further prepared by being degreased with a suitable solvent or detergent of a type well known in the art. The rotor blade 12 is then masked to expose only the tip 16 of the rotor blade 12, which serves as the bonding surface. In addition, the dust exit holes 19 formed in the tip 16 of the rotor blade 12 are masked by any suitable means.

The blade tip 16 is then blasted using a blasting medium, such as a nickel-base blasting medium sold under the name NICROBLAST MEDIA by Wall Colmonoy Corporation of Madison Heights, Mich. Such a nickel-base blasting medium is preferred because it leaves a nominal nickel layer (less than about 0.0001 inch) on the rotor blade tip 16 which serves to wet its bonding surface and thereby promote bonding of the preform 14. However, it is foreseeable that other blasting mediums known to those skilled in the art can be used with acceptable results. Thereafter, the dust exit holes 19 are re-exposed by removing the masking material used prior to the blasting operation, and the entire rotor blade 12 is flushed with dry, filtered air to remove any excess blasting medium. Preferably, a one eighth inch band of stop-off, such as NICROBRAZ-GREEN STOPOFF, a product of Wall Colmonoy Corporation of Madison Heights, Mich., is then applied to the rotor blade 12 surfaces surrounding the bonding surface to prevent brazing at these regions.

A braze tape 22, and more preferably a cobalt-base braze tape comprised of the aforementioned AMS 4783 cobalt-base braze alloy having a thickness of about 0.004 to about 0.006 inches, is then applied to the bonding surface of the preform 14 using a suitable adhesive 24 deposited on the braze tape 22. If applicable, dust exit holes 28 must be formed through the portion of the braze tape 22 which would otherwise cover the dust exit holes 19 in the preform 14.

The preform 14 is then temporarily attached to the tip 16 of the rotor blade 12 with a suitable transfer tape 26, such as type 9710 Transfer Tape, a product of 3M Company of St. Paul, Minn. The transfer tape 26 is first attached to the cleaned bonding surface of the rotor blade tip 16, with dust exit holes 29 again being formed in the transfer tape 26 to ensure that the dust exit holes 19 in the rotor blade tip 16 are not obstructed. A quantity of stop-off, such as the OMNI-PINK STOPOFF PASTE, Spec. No. 470, a product of Omni Technologies Corporation of Exeter, N.H., is then applied in the dust exit holes 19 of the rotor blade 12.

Because the preform 14 is rigid after consolidation, sufficient force must be imposed on the preform 14 at the bonding temperature to bring the entire bonding surface of the preform 14, including the braze tape 22, into register with the rotor blade tip 16. Ceramic weights having cavities which are contoured to match the arc drop of the rotor blade tip 16 are preferably used due to the high bonding temperatures which follow.

For the bonding process, the rotor blade 12 is preferably oriented vertically such that the preform 14 rests on top of the tip 16 of the rotor blade 12. The bonding process must be performed in a clean inert atmosphere, such as an out-gassed vacuum furnace, with the furnace preferably being evacuated to a pressure of no more than about $1\times10^{-4}$ torr. The heating schedule is determined by the need to bond the preform 14 to the rotor blade tip 16 while also preserving the structure and properties of the supporting nickel-base superalloy turbine blade 12. While specifically adapted to the property limitations of the preferred nickel-base superalloy, the composition of the preform 14 and the preferred heating schedule described below may also be applicable to other rotor blade alloys where mechanical property requirements are met in conjunction with the constraints imposed by the required bonding cycle.

The heating rates, durations and limits for the preferred bonding heating schedule are detailed in Table II below.

TABLE II

PREFERRED BONDING FURNACE SCHEDULE

| RATE | TEMPERATURE TIME |
|---|---|
| Heat 15° F./minute (min) | Room temperature to 2000 +/− 25° F. |
| Hold at: | 2000 +/− 25° F. for about 10 to about 30 minutes |
| Heat 30° F./minute (min) | 2000 +/− 25° F. to 2160 +/− 15° F. |
| Hold at: | 2160 +/− 15° F. for about 50 to about 70 minutes |
| Vacuum or gas cool | 2160 +/− 15° F. to 2000 +0/− 25° F. |
| Gas fan cool at 50° F./minute (min) | 2000 +0/− 25° F. to below 1400° F. |

Note: Temperatures given are set points;
+/− tolerances are the preferred control ranges.

The preferred temperatures and durations indicated above are selected to perform the following. First, the temperature of the preform 14 and rotor blade 12 is raised at a rate of about 15° F. per minute minimum, which is sufficient to minimize the exposure of the rotor blade 12 to high temperature, and held at about 2000°±25° F. for about 10 minutes, a duration which is sufficient to thermally stabilize the rotor blade 12. Thereafter, the temperature of the preform 14 and rotor blade 12 is further raised at a rate of about 30° F. per minute maximum, which is sufficient to prevent liquation of the cobalt-base AMS 4783 braze tape 22, and held at about 2160°±15° F. for about 50 to about 70 minutes, a duration which is sufficient to allow the cobalt-base AMS 4783 braze tape 22 to flow and form a strong metallurgical bond between the preform 14 and the rotor blade 12. It is believed that the aforementioned chemical bond between the abrasive particle/titanium interface and the titanium/matrix interface provides for a bond between the abrasive particles and the cobalt base matrix which is stronger than mere mechanical trapping of the abrasive particles. The result is the abrasive blade tip cap 30 and the abrasive rotor blade 10 shown in FIG. 2.

While the above heating rates, temperatures and durations are recommended for the preferred nickel-base superalloy, it is foreseeable that modifications such as the elimination of all but a single heating step to the preferred consolidation or bonding process could be used. In addition, it is believed that the bonding temperature could vary between about 2145° F. and about 2175° F., while still achieving adequate results—i.e., a suitably strong bond between the abrasive blade tip cap 30 and the rotor blade 12 without degradation of the rotor blade's microstructure and mechanical properties. However, the above temperatures are preferred for the particular combination and proportions of materials used. In addition, it is foreseeable that suitable results could also be obtained with holding durations which are outside of the preferred range, such as between about 30 minutes up to about 120 minutes, although the preferred range is favored since it provides the desired results within a practical production schedule.

Following the above heating steps, the preform 14 and rotor blade 12, now as the unitary abrasive rotor blade 10, are gas cooled, such as by flowing an inert gas within the furnace chamber, to a temperature of about 2000°±25° F. Gas cooling to this temperature is preferred because it ensures solidification of the braze alloy used in bonding the preform 14 to the rotor blade 12 prior to gas fan cooling. Thereafter, the abrasive rotor blade 10 is gas fan cooled to below about 1400° F. at a rate of at least 50° F. per minute, which is sufficient to maintain the desired structure and resultant strength level of the rotor blade 12. The abrasive rotor blade 10 is then cooled below this temperature to room temperature by gas fan cooling or by furnace cooling. The rate of cooling below about 1400° F. does not appear to be critical to the success of this invention.

The abrasive rotor blade 10 is then assembled, along with other abrasive rotor blades 10 and possibly uncapped rotor blades 12, to a turbine wheel or other appropriate fixture and ground to the final dimensions using silicon carbide or diamond grinding wheels, following machining parameters which are generally well known in the art. In addition, the surface of the abrasive blade tip cap 30 may be chemically or electrochemically etched to better expose the abrasive particles to improve initial abrasiveness.

The relatively thick (equivalent to multiple abrasive particle diameters) abrasive blade tip cap 30 provides sufficient stock for machining while retaining adequate thickness to accommodate repeated rub encounters over the life of the turbine engine. This feature is contrary to abrasive caps formed by plating entrapment processes wherein the abrasive cap has a thickness equivalent to only one grit particle which is applied to a finish-machined rotor blade. As a result, significant assembly and disassembly operations are typically necessary because the application environment may be detrimental to some components of the rotor assembly, and the abrasive blade tip cap has a significantly shorter service life due to its limited thickness.

It has been determined that the bonding schedule of this invention is capable of sufficiently bonding the preform 14 to the rotor blade 12 without impairing the integrity of the structure of the nickel-base superalloy turbine rotor blade 12. As a result, the high temperature properties of the superalloy are retained, a critical factor in the environment of a modern turbine engine.

It should also be noted that the preform 14, once consolidated during the consolidation heating schedule, is characterized as having sufficient structural and bond strength to survive the high rotational speeds and temperatures of a turbine engine and numerous rub encounters with the engine shroud. Specifically, the particular composition of the preform 14 is able to fully utilize the various stages of the heating schedule to complete the consolidation and bonding processes. In addition, the abrasive blade tip cap 30 is inherently corrosion resistant due to the presence of cobalt as the primary constituent of the metal powder matrix.

It is a particular feature of the present invention that the abrasive particles are tightly bonded within the metal powder matrix, and that the reactive metal coating on the abrasive particles serves to wet the surface of the abrasive particles so as to promote a metallurgical bond between the abrasive particles and the metal powder matrix. As a result, the retention and durability of the abrasive particles is enhanced. The metal powder matrix is formulated to provide bond strength between individual abrasive particles and between the abrasive blade tip cap 30 and the rotor blade 12, while also providing corrosion resistance. The bond strength is characterized as being sufficient to meet the tensile strength necessitated by the centrifugal forces generated by the high speed rotation of the turbine rotor.

Moreover, prior to consolidation, the preform 14 is sufficiently rigid to permit handling procedures typical in manufacturing environments. After consolidation, the preform 14 can be accurately sized to fit the rotor blade tip 16 in that no shrinkage is observed after bonding. In addition, by using any of the precision cutting operations described above, small details can be precisely located in the preform 14 after consolidation, such as the dust exit holes 20 shown in FIGS. 1 and 2.

The processes of the present invention also permit relatively thick preforms 14 to be formed and bonded to the rotor blades 12 such that subsequent machining of the abrasive blade tip cap 30 can be performed to bring the abrasive rotor blade 10 into tolerance while ensuring that sufficient abrasive material will remain to provide repeated rub encounters over the life of the turbine engine.

Finally, a primary advantage of the present invention is that the heating schedule employed ensures that alteration of the rotor blade microstructure is eliminated, such that the high temperature capabilities of the superalloy will remain intact. The two separate furnace operations required to consolidate the preform 14 and bond the preform 14 to the rotor blade 12 ensures that each occurs under conditions most suited for the particular process. Neither consolidation nor bonding need be compromised to acquire the necessary parameters of the other. In addition, because the microstructure of the rotor blade 12 is not altered, the abrasive rotor blades 10 formed by this process can be reworked and overhauled by retipping, an extremely important aspect in terms of manufacturing and maintenance costs.

As previously noted, in addition to single crystal rotor blades, the separate consolidation and bonding processes of the present invention are also well suited for forming abrasive blade tip caps 30 on equiaxed grain and directionally solidified rotor blades. Because the consolidation heating cycle described above is completed without the rotor blade 12, the preforms 14 can be later bonded to either single crystal or equiaxed rotor blades. Moreover, the bonding heating cycle described above is suitable for bonding the preform 14 to rotor blades of either crystal structure. Since the bonding temperature of about 2160° F. corresponds to temperatures encountered elsewhere in the processing of turbine blades of both crystal structures, no penalty in mechanical properties is incurred which is directly attributable to the bonding process for the preform 14.

The consolidation process also provides a significant economic advantage from the standpoint of time, labor and energy requirements. Because of the relatively small size of the preform 14, many preforms 14 can be formed from a single abrasive mat which can be consolidated during a single furnace operation. In addition, the step of processing the preform 14 prior to bonding to the rotor blade 12 significantly shortens the bonding cycle. As a result, the present invention is highly suitable for the mass production of turbine rotor blades.

While our invention has been described in terms of a preferred embodiment, it is apparent that other forms could be adopted by one skilled in the art; for example by substituting other melting point depressants, such as silicon, other matrix or braze compositions such as nickel-base alloys for the preferred cobalt-base compositions, other abrasive materials, such as silicon carbide, tantalum carbide and cubic boron nitride, for the preferred aluminum oxide, omission of the binder for less demanding applications, or the use of mixtures of abrasive materials or grit sizes. Accordingly, the scope of our invention is to be limited only by the following claims.

The embodiments of the invention in which an exclusive property or privilege is claimed are defined as follows:

1. A method for bonding an abrasive blade tip cap to the tip of a rotor blade, said method comprising the steps of:

forming a mat from an abrasive composition;

heating said mat to a temperature which is sufficient to consolidate said abrasive composition;

cooling said mat to a temperature sufficient to solidify said abrasive composition;

forming a preform from said mat;

mounting said preform to a bonding surface on said tip of said rotor blade;

heating said preform and said rotor blade to a temperature so as to bond said preform to said tip without degrading the microstructure and strength of said rotor blade, said preform forming said abrasive blade tip cap upon bonding to said rotor blade;

cooling said abrasive blade tip cap and said rotor blade.

2. A method for bonding an abrasive rotor blade tip cap to the tip of a rotor blade as recited in claim 1 wherein said abrasive composition comprises:

a metal powder matrix containing a cobalt base braze alloy and a cobalt alloy containing boron; and abrasive ceramic particles interspersed in said metal powder matrix, said abrasive ceramic particles being coated with a reactive metal;

wherein said boron is present in sufficient amounts to aid in wetting and bonding of said metal powder matrix and said abrasive ceramic particles into a fully densified matrix upon sufficient heating of said abrasive blade tip cap preform.

3. A method for bonding an abrasive rotor blade tip cap to the tip of a rotor blade as recited in claim 1 wherein said abrasive composition comprises more than about 1 weight percent and less than about 2 weight percent of said boron.

4. A method for bonding an abrasive rotor blade tip cap to the tip of a rotor blade as recited in claim 1 wherein said temperature for consolidating said abrasive composition is about 2275° F. to about 2325° F.

5. A method for bonding an abrasive rotor blade tip cap to the tip of a rotor blade as recited in claim 1 said step of heating said mat further comprises heating said mat to a temperature of between about 1075° F. and about 1125° F. at a rate sufficient to volatilize binders in said mat without distortion.

6. A method for bonding an abrasive rotor blade tip cap to the tip of a rotor blade as recited in claim 1 further comprising the step of cleaning and preparing said bonding surface with a nickel-base brazing alloy prior to mounting said mat to said tip.

7. A method for bonding an abrasive rotor blade tip cap to the tip of a rotor blade as recited in claim 1 wherein said step of heating said mat and said rotor blade further comprises heating to a temperature of about 1975° F. to about 2025° F. at a rate of about 15° F. per minute and holding for about 10 to about 30 minutes.

8. A method for bonding an abrasive rotor blade tip cap to the tip of a rotor blade as recited in claim 1 wherein said step of heating said mat and said rotor blade further comprises heating to a temperature of about 2145° F. to about 2175° F. at a rate of about 30° F. per minute and holding for about 50 to about 70 minutes.

9. A method for bonding an abrasive rotor blade tip cap to the tip of a rotor blade as recited in claim 1 wherein said cooling step comprises cooling said abrasive blade tip cap and said rotor blade from a temperature of between about 1975° F. to about 2025° F. to a temperature of about 1400° F. at a rate of about 50° F. per minute.

10. A method for bonding an abrasive blade tip cap to the tip of a rotor blade, said method comprising the steps of:

forming a mat from an abrasive composition, said abrasive composition comprising:

a metal powder matrix containing a cobalt base braze alloy and a cobalt alloy containing boron; and abrasive ceramic particles interspersed in said metal powder matrix, said abrasive ceramic particles being coated with a reactive metal;

wherein said boron is present in sufficient amounts to aid in wetting and bonding of said metal powder matrix and said abrasive ceramic particles into a fully densified matrix upon sufficient heating of said abrasive blade tip cap preform;

heating said mat to a temperature which is sufficient to consolidate said abrasive composition;

cooling said mat to a temperature sufficient to solidify said abrasive composition;

forming a preform from said mat;

mounting said preform to a bonding surface on said tip of said rotor blade;

heating said preform and said rotor blade to a temperature and holding said preform and said rotor blade at said temperature for a duration which is sufficient to bond said preform to said tip without degrading the microstructure and strength of said rotor blade, said preform forming said abrasive blade tip cap upon bonding to said rotor blade;

cooling said abrasive blade tip cap and said rotor blade to a temperature which is sufficient to solidify the bond between said preform and said rotor blade;

further cooling said abrasive blade tip cap and said rotor blade at a rate sufficient to maintain the microstructure and strength of said rotor blade.

11. A method for bonding an abrasive rotor blade tip cap to the tip of a rotor blade as recited in claim 10 wherein said abrasive composition comprises more than about 1 weight percent and less than about 2 weight percent of said boron.

12. A method for bonding an abrasive rotor blade tip cap to the tip of a rotor blade as recited in claim 10 said step of heating said mat further comprises heating said mat to a temperature of between about 1075° F. and about 1125° F. at a rate sufficient to volatilize binders in said mat without distortion.

13. A method for bonding an abrasive rotor blade tip cap to the tip of a rotor blade as recited in claim 10 wherein said step of heating said mat further comprises heating to a temperature of between about 1975° F. and about 2025° F.

14. A method for bonding an abrasive rotor blade tip cap to the tip of a rotor blade as recited in claim 10 wherein said temperature for consolidating said abrasive composition is about 2275° F. to about 2325° F.

15. A method for bonding an abrasive rotor blade tip cap to the tip of a rotor blade as recited in claim 10 further comprising the step of adhering a braze tape to said preform prior to said mounting step.

16. A method for bonding an abrasive rotor blade tip cap to the tip of a rotor blade as recited in claim 10 further comprising the step of adhering an adhesive transfer tape to said bonding surface such that said preform is adhered to said bonding surface prior to bonding said preform to said rotor blade.

17. A method for bonding an abrasive rotor blade tip cap to the tip of a rotor blade as recited in claim 10 further comprising the step of cleaning and preparing said bonding surface with a nickel-base brazing alloy prior to mounting said preform to said tip.

18. A method for bonding an abrasive rotor blade tip cap to the tip of a rotor blade as recited in claim 10 wherein said step of heating said preform and said rotor blade further comprises heating to a temperature of about 1975° F. to about 2025° F. at a rate of about 15° F. per minute and holding for about 10 to about 30 minutes.

19. A method for bonding an abrasive rotor blade tip cap to the tip of a rotor blade as recited in claim 10 wherein said step of heating said preform and said rotor blade further comprises heating to a temperature of about 2145° F. to about 2175° F. at a rate of about 30° F. per minute and holding for about 50 to about 70 minutes.

20. A method for bonding an abrasive rotor blade tip cap to the tip of a rotor blade as recited in claim 10 wherein said cooling step comprises cooling said abrasive blade tip cap and said rotor blade from a temperature of between about 1975° F. to about 2025° F. to a temperature of below about 1400° F. at a rate of about 50° F. per minute.

* * * * *